United States Patent [19]

Nutting et al.

[11] 4,217,807

[45] Aug. 19, 1980

[54] STEMWARE MUSICAL INSTRUMENT

[76] Inventors: Donald Nutting, 1295 Ithaca Dr., Boulder, Colo. 80303; James P. Turner, 905 Grape St., Boulder, Colo. 80302

[21] Appl. No.: 926,722

[22] Filed: Jul. 21, 1978

[51] Int. Cl.[2] ..... G10D 13/08

[52] U.S. Cl. ..... 84/402; 84/423 R

[58] Field of Search ..... 84/1, 102, 103, 402, 84/403, 404, 410, 2, 170, 177, 330, 423

[56] References Cited

U.S. PATENT DOCUMENTS

| | | | |
|---|---|---|---|
| 493,066 | 3/1893 | Carpigiani | 84/402 |
| 3,146,658 | 9/1964 | Mandy et al. | 84/423 X |
| 3,916,754 | 9/1975 | Thiel | 84/423 B X |

FOREIGN PATENT DOCUMENTS

| | | | |
|---|---|---|---|
| 29975 | 12/1909 | United Kingdom | 84/103 |

*Primary Examiner*—Lawrence R. Franklin
*Attorney, Agent, or Firm*—Richard D. Law

[57] ABSTRACT

Stemware of goblets secured in adjoining positions on a mounting board in vertical and horizontal rows, with adjacent goblets rim rubable by one hand, with the goblets in the horizontal rows arranged in tones for basic chords; for example, a first row in IV chord (subdominant), the next row is $V_7$ chord (dominant) and the third row is I chord (tonic). The goblets are tuned by a partial filling of water, and the water level and the produced note are marked on the glass. The sounding board is marked for the positioning of the tuned goblets to permit the forming of the chords and easy playing by rim rubbing the stemware glasses.

8 Claims, 14 Drawing Figures

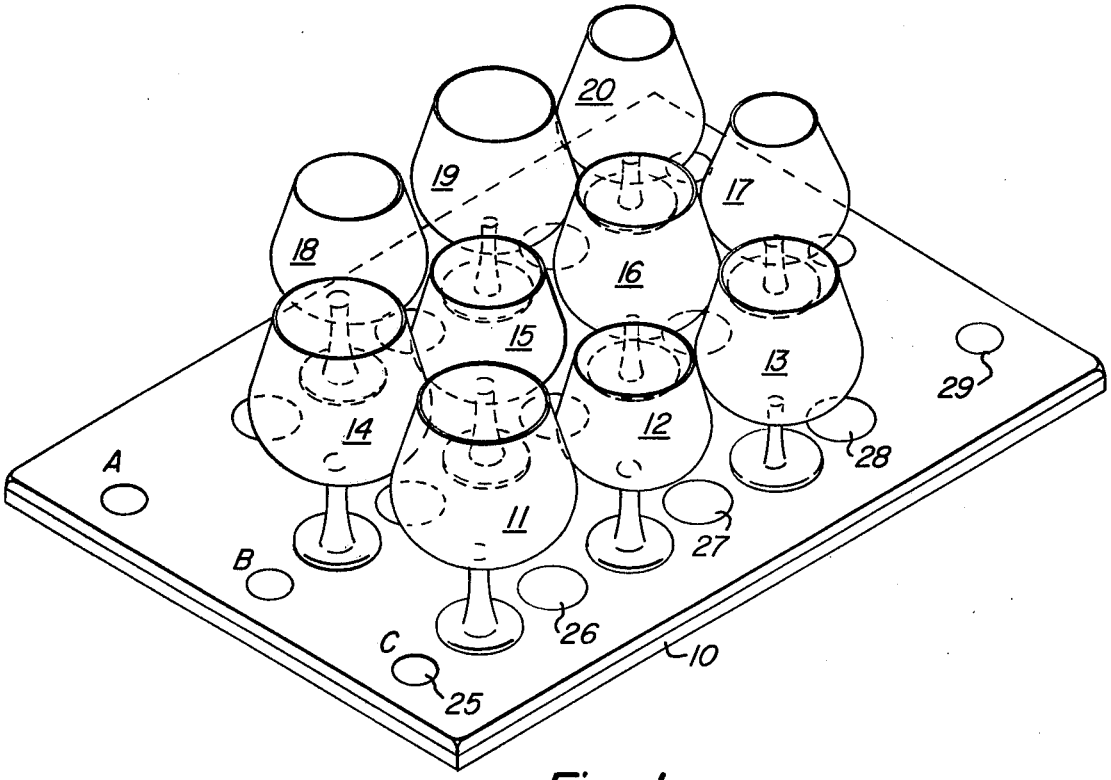
Fig-1
Fig-2
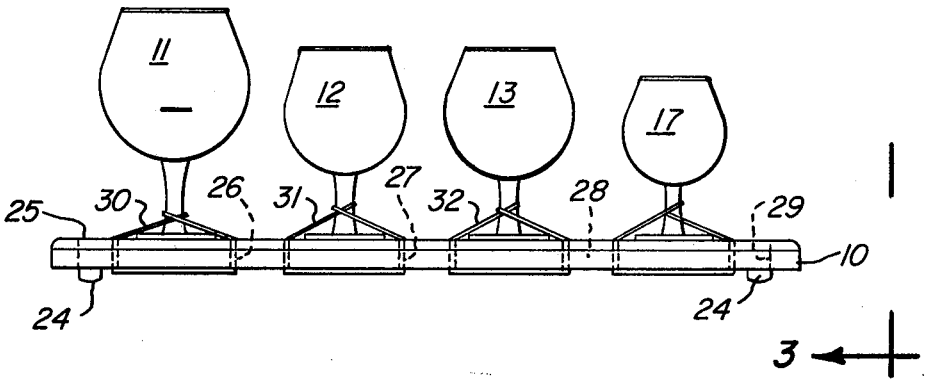

Michael Row The Boat Ashore

STEMWARE MUSICAL INSTRUMENT

It is known that some goblets or stemware produce tones when rim rubbed with a non-oily, water-wet finger. Sets of such goblets have heretofore been used to produce musical compositions, and several professional musicians have used a set of goblets as a musical instrument. The sets hereto used have been hand blown and are carefully selected crystal goblets or stemware. The sets of the crystal glassware have generally been positioned in one single row, in the manner of the white keys of a piano, or in rare instances in the designs deemed most appropriate to the individual, and the designs are changed as desired. These instruments are then played in the same manner as the white keys of a piano. One disadvantage is that only one goblet may be played by one hand at a time, which permits one hand to play one note and the other hand to play another note, to form chords for instance.

The stemware may be made to produce a sound either by tapping or by rubbing a non-oily, water-wet finger around the rim of the goblet. The prior method produces a single, quick note, while the latter may produce a continuous note for as long as the rim is rubbed.

THE INVENTION

According to the present invention, there is provided a mounting board marked for the specific placement of goblets which are tuned to a particular note and so marked. Means are provided for securing the goblets on the mounting board in vertical and horizontal rows in close proximity to each other so that at least any adjacent two or more goblets, either and/or both in vertical and/or horizontal rows, may be rim rubbed by a single hand, to produce a chord. In form of the invention, the tuned goblets are positioned in the rows, so that there are three horizontal rows and four vertical rows, permitting a single hand to rub two goblets in a horizontal row and a single goblet in an adjacent row producing a predetermined chord, for example, with other chords formed by different sets of the glasses. The placement of the goblets permits running a diatonic scale in a prescribed pattern, generally two adjacent box-like configurations of four glasses each. In one form of the invention, the board is arranged for three horizontal rows, the first row having three goblets, the second row having four goblets, and the third row having three goblets. The first row of three goblets is aligned with the three right hand goblets of the second row and the third row aligned with the left hand goblets of the second row. This leaves an empty space on the left end of the first row and an empty space on the right end of the third row. A goblet of a lower leading tone may be secured to the board at the former empty space and an upper super tonic tone goblet secured to the latter empty space to add further versatility to the instrument.

A simple attachment means is provided for each goblet including spaced holes through the base on either side of the goblet base position. A rubber band is passed through adjacent holes and the rubber band is looped around the stem of the goblet, so that both ends of the rubber band are looped around the stem and under the mounting base securing the goblet to the board. Thus, each goblet position has a pair of holes, and some holes are common to adjacent goblets.

OBJECTS AND ADVANTAGES OF THE INVENTION

It is therefore, included among the objects and advantages of the invention to provide an inexpensive acoustical musical instrument having a melodious and rich sound.

Another object of the invention is to provide a musical instrument which is easy and simple to play, and a musical score may be adapted by diagrams so that songs may be played by persons having no musical knowledge.

Still another object of the invention is to provide a mounting board for a simple attachment and prepositioned arrangement of tuned goblets whereby single notes, scales and chords may be easily played, and in which chords may be played by rim rubbing with a single hand.

Yet another object of the invention is to provide a mounting board on which goblets may be easily secured by rubber bands passing through holes through the board on each side of the goblet.

An additional object of the invention is to provide a unique positioning of tuned goblets for the playing of chords formed by rim rubbing of two or three goblets with a single hand.

A further object of the invention is to provide a musical instrument of tuned goblets mounted in a folding, legged cabinet for easy portability and set-up of the instrument.

These and other objects and advantages of the invention may be ascertained by reference to the following description and appended drawings.

GENERAL DESCRIPTION OF THE DRAWINGS

FIG. 1 is a perspective view of one form of the invention;

FIG. 2 is a side elevational view of the device of FIG. 1;

Figure 8:
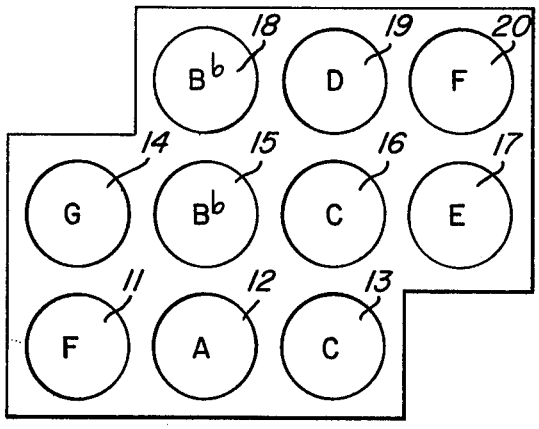
FIG. 8 is a schematic arrangement of tuned goblets on a mounting board in a prescribed note arrangement permitting single hand chord playing.
Figure 9:
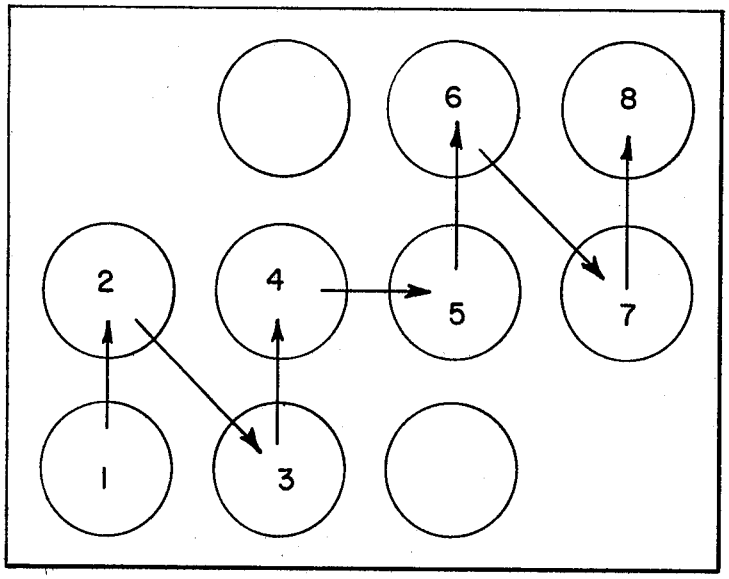
FIG. 9 is a schematic showing of the track to be followed, for playing a diatonic scale, for the board arrangement of FIG. 8.
Figure 10:
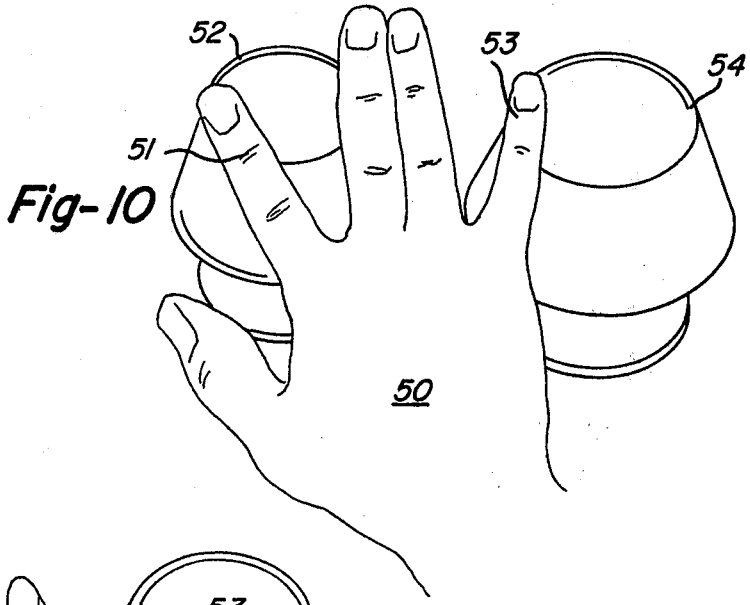
Figure 11:
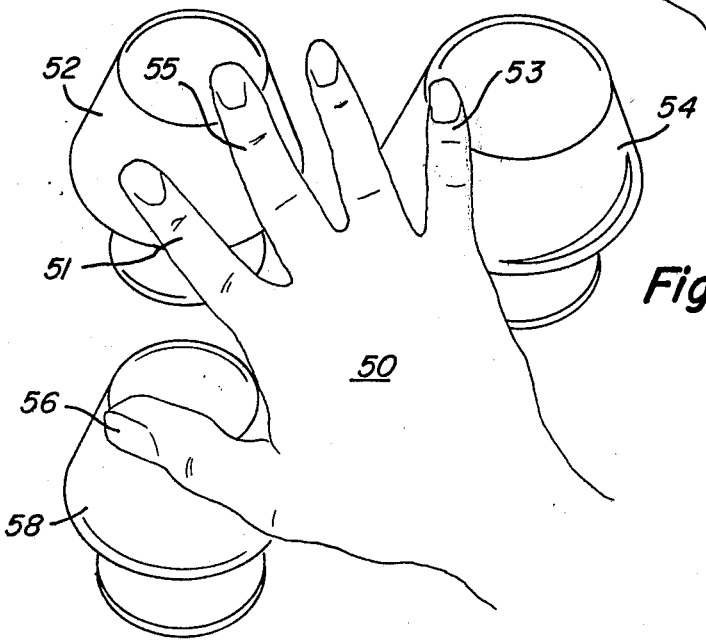
Figure 12:
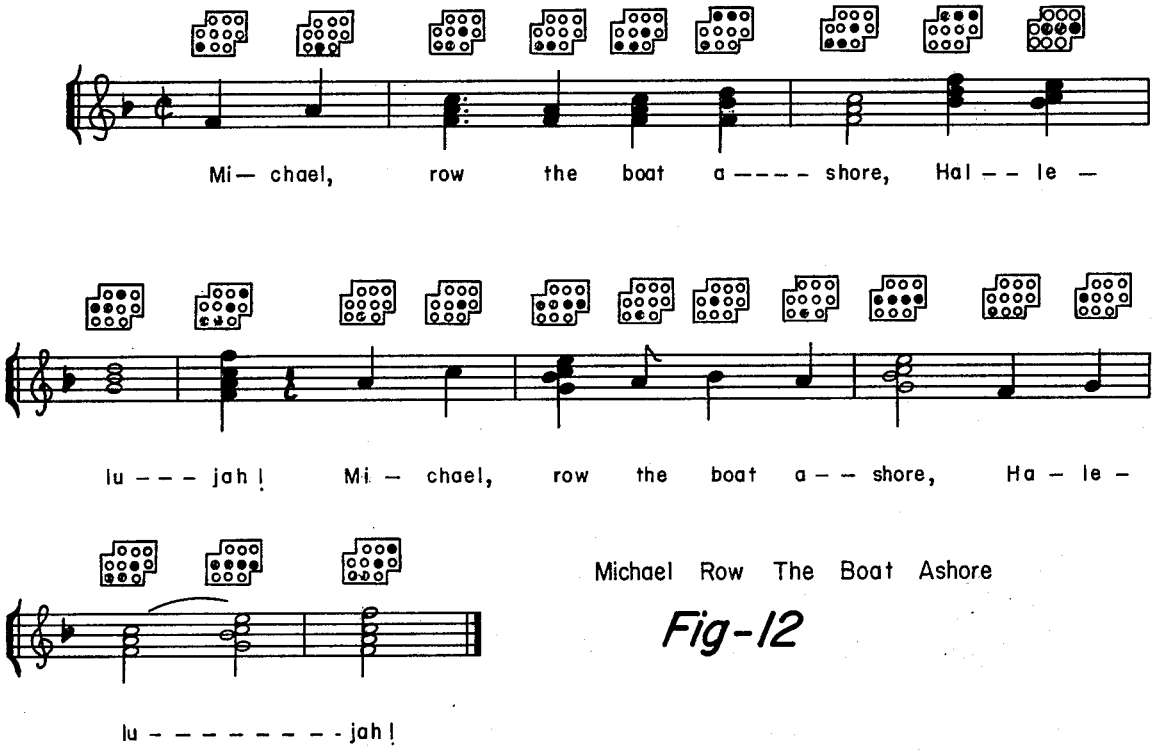
Figure 13:
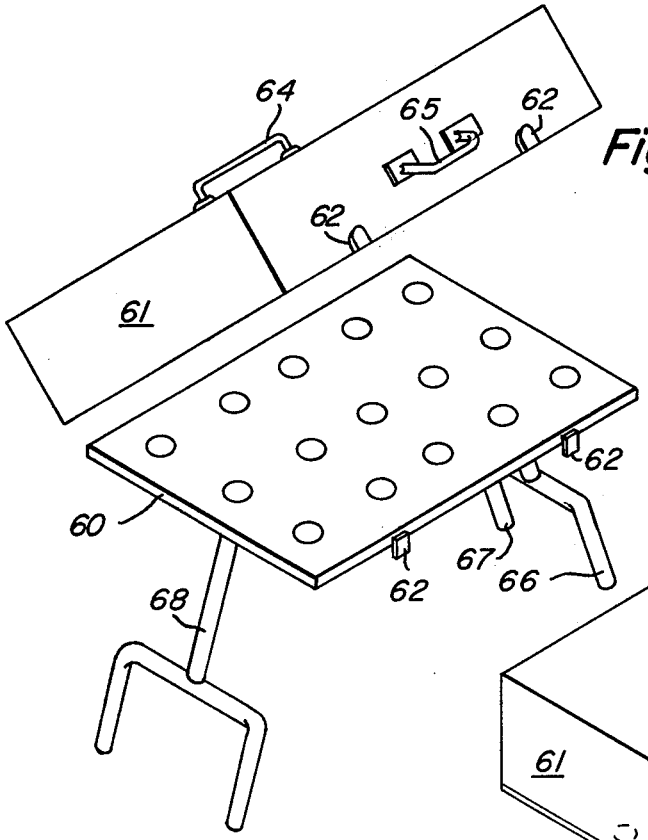
Figure 14:
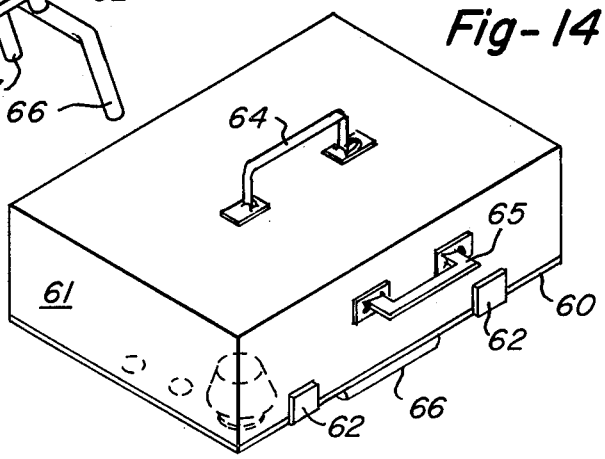

FIG. 10 schematically shows hand positioning for two goblet chord playing, and FIG. 11 schematically shows hand positioning for three goblet chord playing;

FIG. 12 is a musical score for "Michael Row the Boat Ashore" with the finger charts for each note or chord, for playing the tune on the arrangement of goblets of FIG. 8;

FIG. 13 is a perspective view of folding cabinet for instrument in upright position; and, FIG. 14 is a perspective view of the unit of FIG. 13 in folded position.

SPECIFIC DESCRIPTION OF THE DRAWINGS

Figure 3:
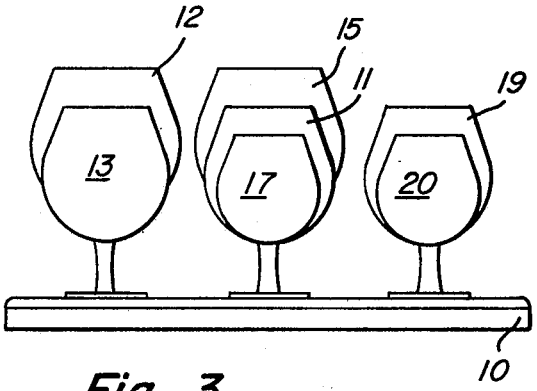
FIG. 3 is an end elevational view of the device of FIG. 1 taken from the right end.

In the device selected for illustration in FIGS. 1–3, the musical instrument includes a mounting board or base 10 which may be solid wood, particle board, cardboard, or the like. The base is preferably rectangular, and is arranged to support a number of goblets, or stemware glasses, designated 11 through 20. These are placed in rows as 11, 12 and 13 in Row C; 14, 15, 16 and 17 in Row B; and 18, 19 and 20 in Row A. The arrangement leaves a space at the right end of Row C and the left end of Row A, explained below. The base is provided with rubber feet 24 for supporting the board, if desired, above a table or other base. A plurality of holes are bored through the base with one hole on each side of the position for the base of each goblet. With the arrangement shown, the middle goblets in a row share a common hole; Row C is explained for this arrangement but the same effect is provided for Rows B and A. A small hole 25 is provided near the left edge of the board on one side of goblet 11. A larger hole 26 is provided on the opposite of goblet 11 and is common for goblet 12. Hole 27 is common for goblets 12 and 13, and hole 28 may be used for goblet 13 and another goblet (not shown) positioned in the space between hole 28 and hole 29. These holes provide simple means for using a rubber band to secure the goblets on the board. Goblet 11 is held by rubber band 30, having both ends looped around the stem of the goblet 11, and under the board through the holes. This securely holds the goblet to the board. In a similar manner, rubber band 31 holds goblet 12 and rubber band 32 holds goblet 13.

Figure 5:
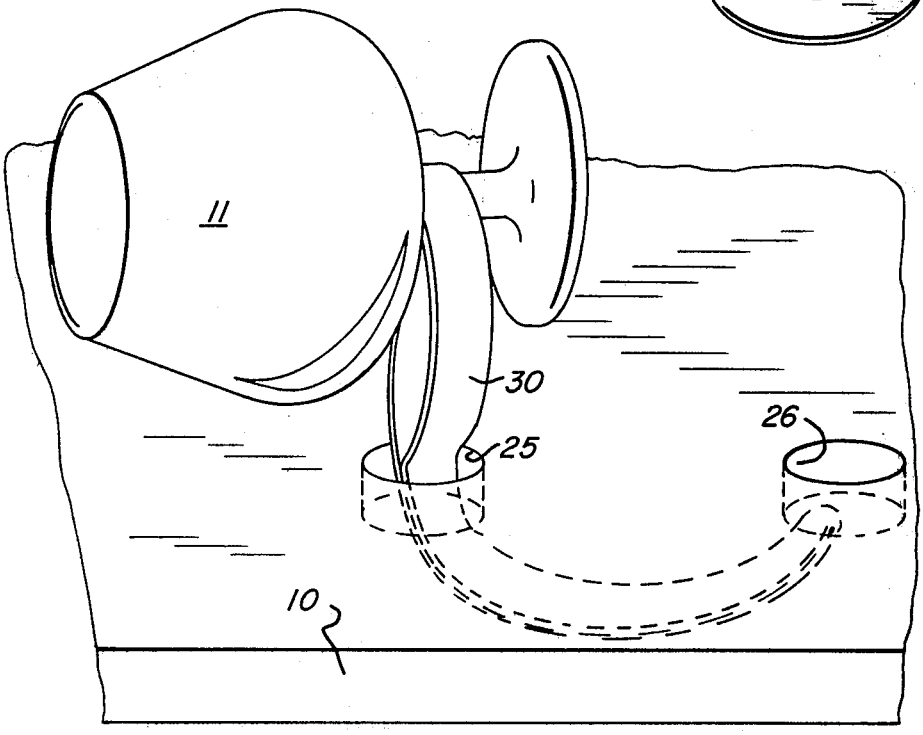
FIG. 5 is a perspective view of the start of the method of a rubber band attachment of a goblet to a mounting board.
Figure 6:
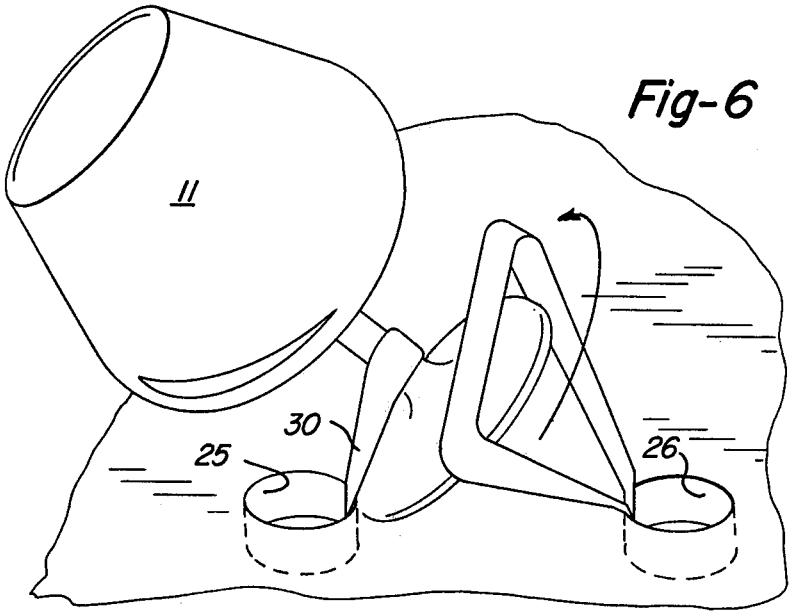
FIG. 6 is a perspective view of a continuation of the method of FIG. 5.
Figure 7:
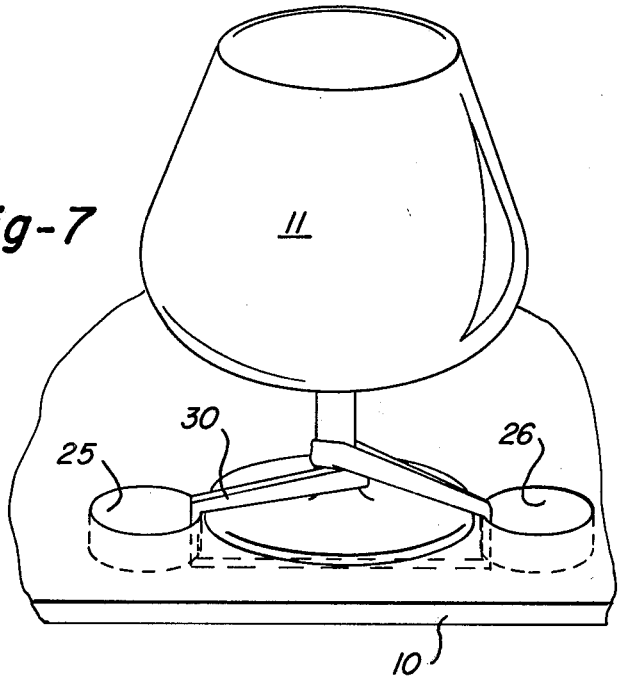
FIG. 7 is a perspective view of secured goblet by a rubber band to a mounting board.

The rubber bands are positioned on the goblets by the method as shown in FIGS. 5, 6 and 7. A goblet 11 has rubber band 30 looped over the stem, and the free end of the flattened band is passed down the hole 25, under the board 10 and out hole 26. The free end of the band 30 is pulled up out of the hole 26 and looped over the stem of goblet 11 along with looped other end. This securely holds the goblet on the board as shown in FIG. 7. In like manner, each goblet is held on the board by a rubber band.

Figure 4:
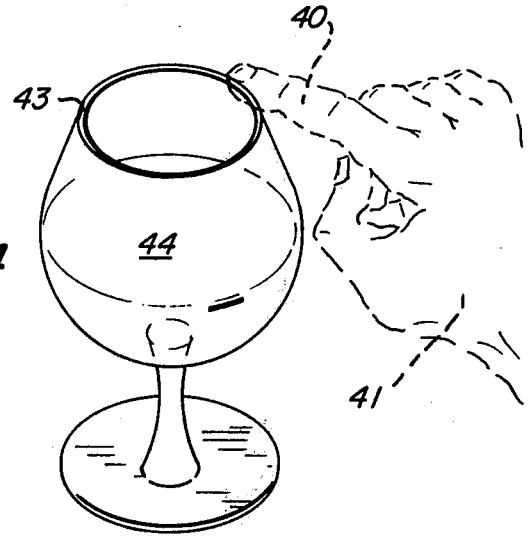
FIG. 4 is a schematic, perspective view of one form of one finger rubbing of the rim of a goblet to make a tone form the goblet.

Sound is produced by a user's finger or fingers rubbing the rim or upper edge of a goblet to create friction between the finger and rim of the goblet. The fingers thus need to be oil free, however, wetted with water. It is preferred to use distilled water, and generally washed hands that are "squeaky clean". Thus, a single finger 40, FIG. 4, of a hand 41 is rubbed around a rim 43 of stemware 44. The finger is moved circularly around the rim either clockwise or counterclockwise. The goblets may be played with a single finger or with multiple fingers, preferably fingers on a single hand, since the instrument is intended to be played with two hands on separate goblets.

The layout of the positions of the goblets on the sounding board is shown in one form in FIG. 8. The top row of goblets have tones as follows: 18 is tuned to B♭, the subdominant, 19 is tuned to D, the submediant, and goblet 20 is tuned to F, the upper tonic. Thus, when the goblets are tuned to the key of F, they produce the IV chord which is the subdominant. The second row has goblet 14 tuned as the supertonic G, goblet 15 is a B♭, the subdominant, goblet 16 is the dominant C, and goblet 17 is the leading tone E. This makes $V_7$ chord which is the dominant (but inverted). The third row includes goblet 11 tuned to the lower tonic F, goblet 12 as the mediant A and goblet 13 as C the dominant. This makes the I chord which is the tonic.

To facilitate the set up of goblets on the board and to facilitate playing of the musical stemware, the goblet positioning in the rows may be colored a different color. For example, the position of the IV chord, the upper row, may be colored green and the printing on the goblets may be green. Similarly, the next row may have positions colored blue and the goblets have blue printing; and the next row with red position indicia and red indicia on the goblet. This permits the playing of the music by the color schemes.

The ascending basic (diatonic scale) is played from the lower left to the upper right, or descending as the reverse pattern. Thus, the scale is run by rim rubbing in sequence, the goblets 11, 14, 12, 15, 16, 19, 17 and 20. Descending scale is the reverse order. For a smooth scale, the left hand rubs the rim of goblet 11, the right hand then rubs 14, the left on 12, the right on 15, the left on 16, the right on 19, the left on 17 and the right finishes on goblet 20. For practice, the sequence is followed up the scale and reverse for decreasing or down the scale. Also, it is advisable to single handedly play the whole scale up and down, then with the other hand, for giving more dexterity in playing.

A chord of double notes may be played by either hand, as in FIG. 10, where a hand 50 uses index finger 51 on a goblet 52 and a little finger 53 on goblet 54. This is a right rim rub, and the goblets are any two adjacent goblets in a horizontal row. A three tone goblet may be produced by the right hand 50, FIG. 11, with the middle finger 55 rubbing goblet 52, the little finger on goblet 54, as above, and the thumb 56 on goblet 58. Again the goblets are those that are adjacent and touchable by the fingers of one normal size adult hand. The arrangement of the goblets, tuned to the specific notes, permits the forming of chords.

A song "Michael Row the Boat Ashore" is shown in FIG. 12, with fingering charts for the board configuration, above each note. The fingering chart is the same as the layout of the board, so the music can be played by one not knowing music, and the charts, also, help those that do know music by indicating the specific fingerings for a given note cluster. In the fingering charts, the lighter colored dots represent the use the left hand and the dark dots represent the use of the right hand. For the tune, the first note is F, and this is made by rim rubbing goblet 11 with a finger or fingers of the right hand. The next note is A, and this is made by rim rubbing goblet 12. The next cluster of notes requires the left hand to simultaneously rim rub goblets 11 and 12 and the right hand, at the same time, to rim rub goblet 16. This produces the chord F, A and C. The remaining portions of the song are produced with the fingering charts followed in the same manner.

For convenience, the unit may be made in a carrying case which also is a stand for playing the instrument. The unit shown in FIGS. 13 and 14 include a base 60, having holes in the base in the manner described above. Goblets are secured to the board by rubber bands in the manner described, and a cover 61 which is sufficiently high to fit over the installed goblets, is arranged to be releasably secured over the board. For securing the cover, latches 62 (luggage latches may be used) on each side releasably secure the cover on the base. The cover includes an upper handle, permitting the base to be carried flat with the goblets in upright position (even containing water). Another handle 65 is mounted on one side to permit the unit to be carried as a satchel. The handles are preferably luggage type handles which fold down out of the way. Legs 66 and 67 are hingedly mounted at one end of the base and are arranged to fold flat against the bottom of the base or extend outwardly for supporting the base. At the other end, a bifurcated leg 68 provides the other end support. This leg is mounted on hinges, and it may be folded flush with the bottom for carrying.

The unit is set up in the manner described for the board with the goblets secured to the base. In this condition, the cover may be secured to the base, the legs folded and the unit carried to the point of use. At the location of use, the legs are extended and the cover removed. The goblets are filled to the fill marks, and the instrument is ready for use.

The goblets may be packaged in a cardboard box for sale, and the bottom (or the top) of the box may be marked as a base.

In this case, punch out holes may be provided for the rubber bands. Also, the board should have indicia for the positions of the equivalent goblet with the equivalent indicia. The indicia may, also, be color coded, as explained above. The arrangement is satisfactory for a temporary base in the initial use of the instrument. A more rigid and substantial base is preferred for long term enjoyment of the instrument.

The goblets satisfactory for the instrument may be any reasonably good grade of stemware. Production grade stemware glasses may be easily tuned by adding water to the goblet, and level of the water necessary to produce the desired tone is marked on the goblet. The indicia is printed on the goblet as to tone, etc. In this manner, production line methods may be used in preparing the instruments. As for example, a number of goblets may be marked for the same tone; one for each of a number of instruments. The rows are described as horizontal and vertical, but obviously the surface of the base is planar and arranged to be used horizontally. Thus, the rows are parallel with an edge and other rows are perpendicular to the first mentioned rows.

The goblets may be tuned and marked, as explained, and packed in a carton or cardboard box. One side of the box may be marked in the manner of a base for the instrument, with punch out holes for the rubber bands. Also, the goblet positions may be marked on the cardboard. Thus, a side of the packing box may be used as the base of the instrument.

While the invention has been described by reference to particular embodiments, there is no intent to limit the spirit or scope thereof to the precise details so set forth, except as defined in the following claims.

What is claimed is:

1. A musical instrument including a plurality of stemware glasses, each tuned to a particular musical note which may include being partially filled with water, and producing such notes on being struck or rim rubbed, comprising:

(a) base means arranged to support at least eight such stemware glasses on the upper surface thereof in upright position;

(b) tone indicia means marked on each stemware glass indicating the particular musical tone including those partially filled with water;

(c) base indicia means on said base indicating the position of each stemware glass according to its tone, said base indicia means arranged at least in 3 horizontal rows with the stemware glasses in each row in close proximity to each other and the stemware in each row is adjacent to the stemware in the neighboring rows whereby a normal size adult hand may rim rub two or more adjacent stemware glasses in the same or adjacent rows to produce a predetermined chord, the first row being tuned for the tones of the submediant and the upper tonic; the second row being tuned for the super tonic, subdominant, dominant, and the leading tone, and the third row being tuned for the lower tonic and the mediant with the subdominant and mediant tones in vertical alignment and the submediant and dominant in vertical alignment; and (d) means for temporarily securing the stemware glasses to said base means.

2. A musical instrument according to claim 1, wherein said base means is particle board.

3. A musical instrument according to claim 1, wherein said base means is cardboard.

4. A musical instrument according to claim 1, wherein the stemware glasses are arranged in three adjacent horizontal and four vertical rows whereby at least three goblets in at least two horizontal rows may be played by one adult hand, and the goblets being tuned for the first row of the subdominant, submediant, and the upper tonic; for the second row of the super tonic, subdominant, dominant and the leading tone, and for the third row of the lower tonic, mediant and dominant, and the two subdominant goblets and the mediant tuned goblet being in vertical row alignment, and the remainder of the glasses being in corresponding vertical row alignment.

5. A musical instrument according to claim 1, wherein an additional glass is mounted at an end of the first and third rows.

6. A musical instrument according to claim 1, wherein said base includes a plurality of holes therethrough spaced apart to permit the base of a stemware glass to rest on the base positioned between two adjacent holes, and a rubber band or elastic band looped over the stem of a glass, passed through one hole under the base and up the adjacent hole and then looped around the stem of same glass from said temporary securing means.

7. A musical instrument according to claim 6, wherein adjacent glasses may use a common hole.

8. A method of forming a musical instrument from tuned stemware glasses, which may contain predetermined quantities of water and are mounted on a base, comprising:

(a) arranging tuned stemware glasses in horizontal and vertical rows on the base, with adjacent glasses in either a horizontal or a vertical row being spaced in close proximity whereby a normal size adult hand is able to rim rub at least two or more adjacent glasses in one or two horizontal rows for producing a chord;

(b) arranging the stemware in at least three horizontal rows including at least eight glasses having the individual tones of an octave;

(c) each horizontal row including goblets having the tones necessary for a standard chord; and, (d) the horizontal rows being staggered so that at least two glasses in adjacent horizontal rows produce a harmonic chord which may be produced by rim rubbing the adjacent glasses with a single hand, the first row of said three horizontal rows having at least three glasses tuned to the subdominant, the submediant and the upper tonic; the second row having at least four glasses tuned to the super tonic, subdominant, dominant, and leading tone with the glass of the subdominant directly under the subdominant glass of the first row, and the third row having glasses tuned to the lower tonic, mediant, and dominant, with the mediant directly under the subdominant, and the glasses being otherwise in vertical row alignment.

* * * * *